US006546634B2

(12) United States Patent
Ming

(10) Patent No.: US 6,546,634 B2
(45) Date of Patent: Apr. 15, 2003

(54) COMPASS CUTTER

(76) Inventor: Chen Shan Ming, P.O. Box 453, Taichung (TW)

( * ) Notice: Subject to any disclaimer, the term of this patent is extended or adjusted under 35 U.S.C. 154(b) by 29 days.

(21) Appl. No.: 09/750,358

(22) Filed: Dec. 29, 2000

(65) Prior Publication Data

US 2002/0083601 A1 Jul. 4, 2002

(51) Int. Cl.[7] ..... B43L 9/04

(52) U.S. Cl. ..... 33/27.032; 33/27.03; 33/464; 33/809; 33/783; 33/811; 33/812

(58) Field of Search ..... 33/27.01, 27.02, 33/27.03, 27.031, 27.032, 27.033, 452, 464, 809, 783, 784, 792, 793, 794, 795, 806, 810, 811, 812, 660, 668, 374

(56) References Cited

U.S. PATENT DOCUMENTS

| | | | | | |
|---|---|---|---|---|---|
| 224,401 | A | * | 2/1880 | Derickson | 33/809 |
| 2,087,600 | A | * | 7/1937 | Knoblauch | 33/27.03 |
| 2,309,809 | A | * | 2/1943 | Vane | 33/27.032 |
| 3,509,631 | A | * | 5/1970 | Shimoyama | 33/27.01 |
| 3,562,773 | A | * | 2/1971 | Wilamowski | 33/812 |
| 3,664,025 | A | * | 5/1972 | Barto | 33/27.03 |
| 4,976,037 | A | * | 12/1990 | Hines | 33/27.03 |
| 5,134,784 | A | * | 8/1992 | Atienza | 33/668 |
| 5,153,998 | A | * | 10/1992 | Duncan | 30/290 |
| 5,313,715 | A | * | 5/1994 | Wang | 33/810 |
| 5,349,760 | A | * | 9/1994 | DeVito | 33/760 |
| 5,379,524 | A | * | 1/1995 | Dawson | 33/768 |
| 5,873,175 | A | * | 2/1999 | Johnston | 33/809 |
| 6,167,628 | B1 | * | 1/2001 | Jones et al. | 33/27.02 |
| 2002/0073568 | A1 | * | 6/2002 | Johnson | 33/668 |

* cited by examiner

*Primary Examiner*—Diego Gutierrez
*Assistant Examiner*—Lydia M. De Jesús
(74) *Attorney, Agent, or Firm*—Harrison & Egbert

(57) ABSTRACT

A compass cutter has a main body fastened with an extension rod which is connected with a slidable seat slidable along the extension rod. The main body is further provided with a locating block, a protective cover, a blade, a fixation block, and an insertion pin. The slidable seat is provided with a locating block, a connection rod, a locating pin, and a shield. The compass cutter can be expanded, through the movement of the extension rod. The locating pin and the blade are covered by the shield to protect the user of the compass cutter.

2 Claims, 6 Drawing Sheets

COMPASS CUTTER

BACKGROUND OF THE INVENTION

1. Field of the Invention

The present invention relates generally to a hand tool, and more particularly to a compass cutter.

2. Description of Related Art

As shown in FIG. 1, a compass cutter of the prior art comprises a main body 10, a slidable seat 11, a connection rod 12, a blade 13, and a locating pin 14. The main body 10 has a length which is so limited as to hinder the application of the prior art compass cutter. In addition, the connection rod 12 can not be folded to make the compass cutter compact to facilitate the carrying of the cutter. Furthermore, the blade 13 and the locating pin 14 are so exposed that they are hazardous to safety of a user of the compass cutter.

BRIEF SUMMARY OF THE INVENTION

The primary objective of the present invention is to provide a compass cutter which is free of the drawbacks of the prior art compass cutter described above.

The compass cutter of the present invention comprises a main body, a slidable seat, an extension rod, a connection rod, and a blade. The extension rod is disposed between the main body and the slidable seat. The blade is secured in place by a fixation block. The connection rod is pivotally fastened with the slidable seat.

The features and the advantages of the present invention will be more readily understood upon a thoughtful deliberation of the following detailed description of the present invention with reference to the accompanying drawings.

DETAILED DESCRIPTION OF THE INVENTION

Figure 1:
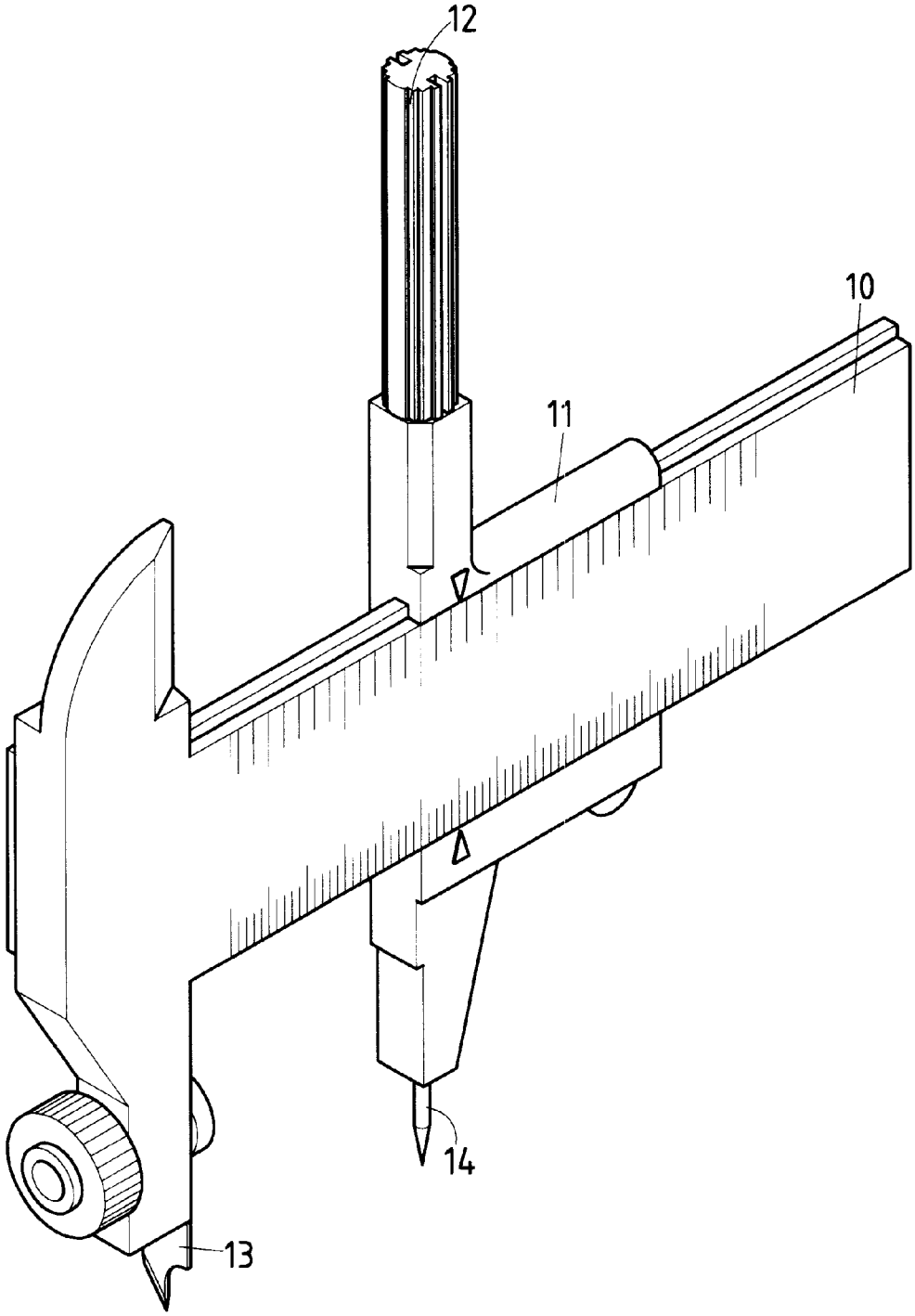
FIG.1 PRIOR ART
FIG. 1 shows a perspective view of a compass cutter of the prior art.
Figure 2:
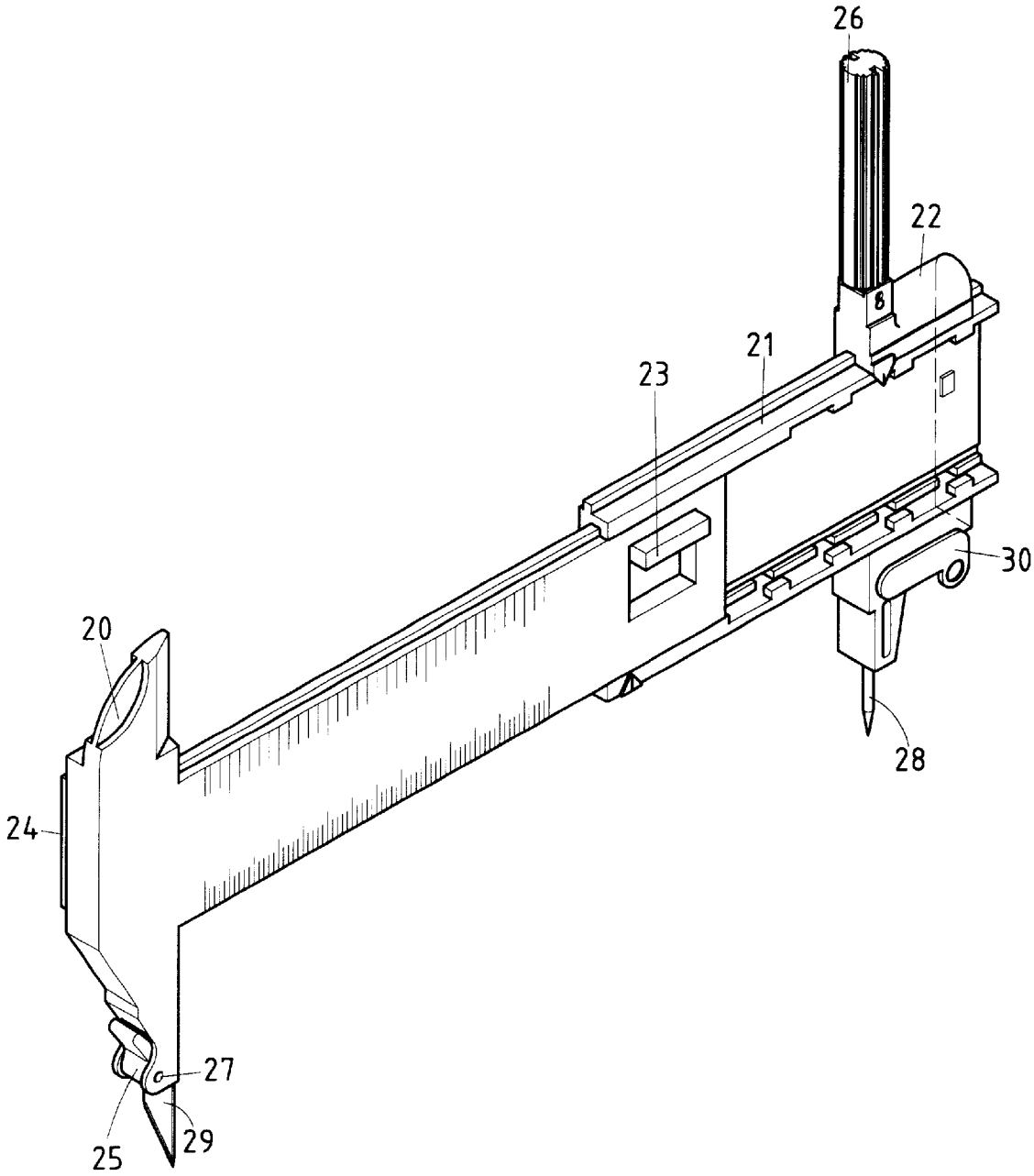
FIG. 2 shows a perspective view of a compass cutter of the present invention.
Figure 3:
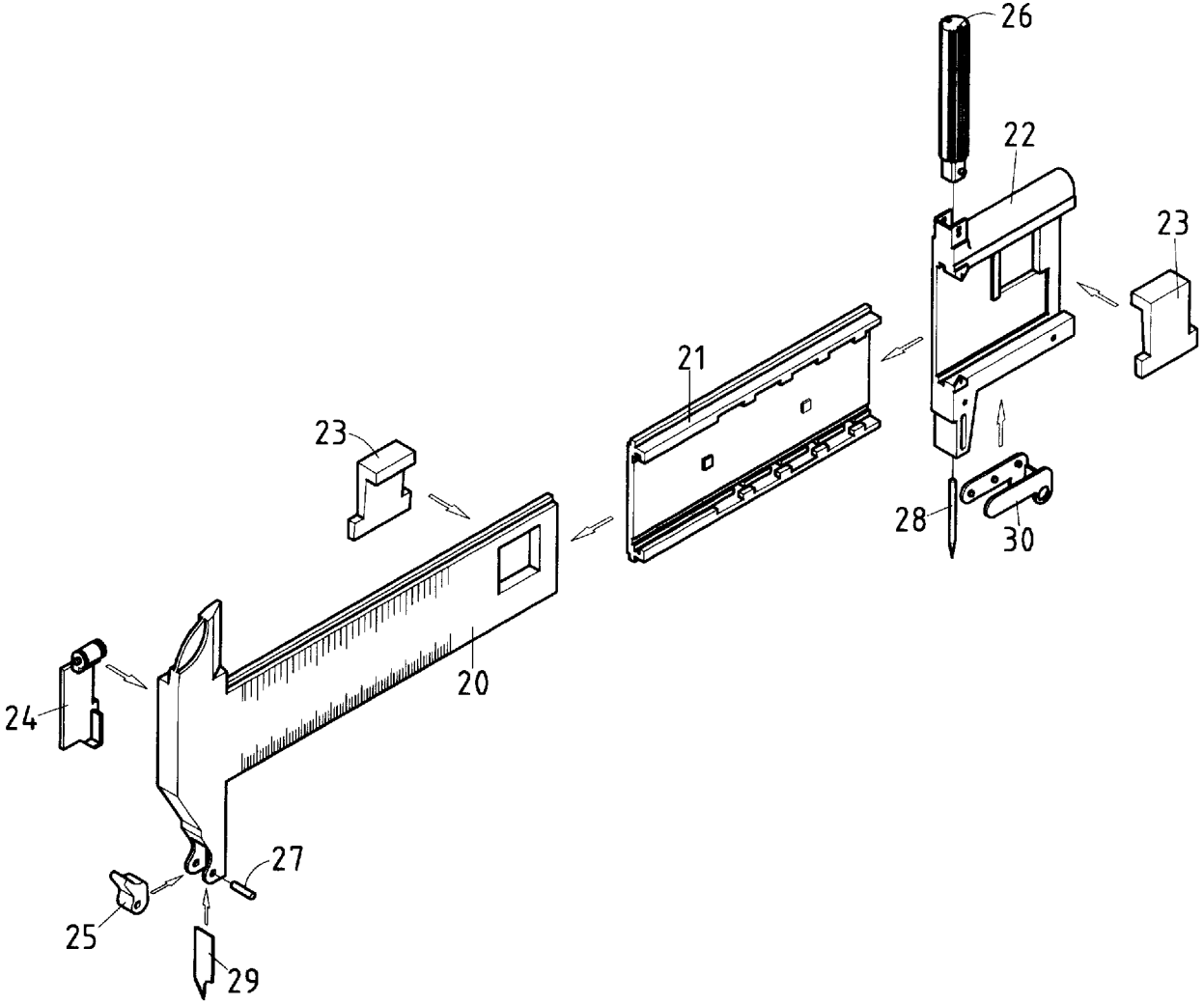
FIG. 3 shows an exploded view of the compass cutter of the present invention.
Figure 4:
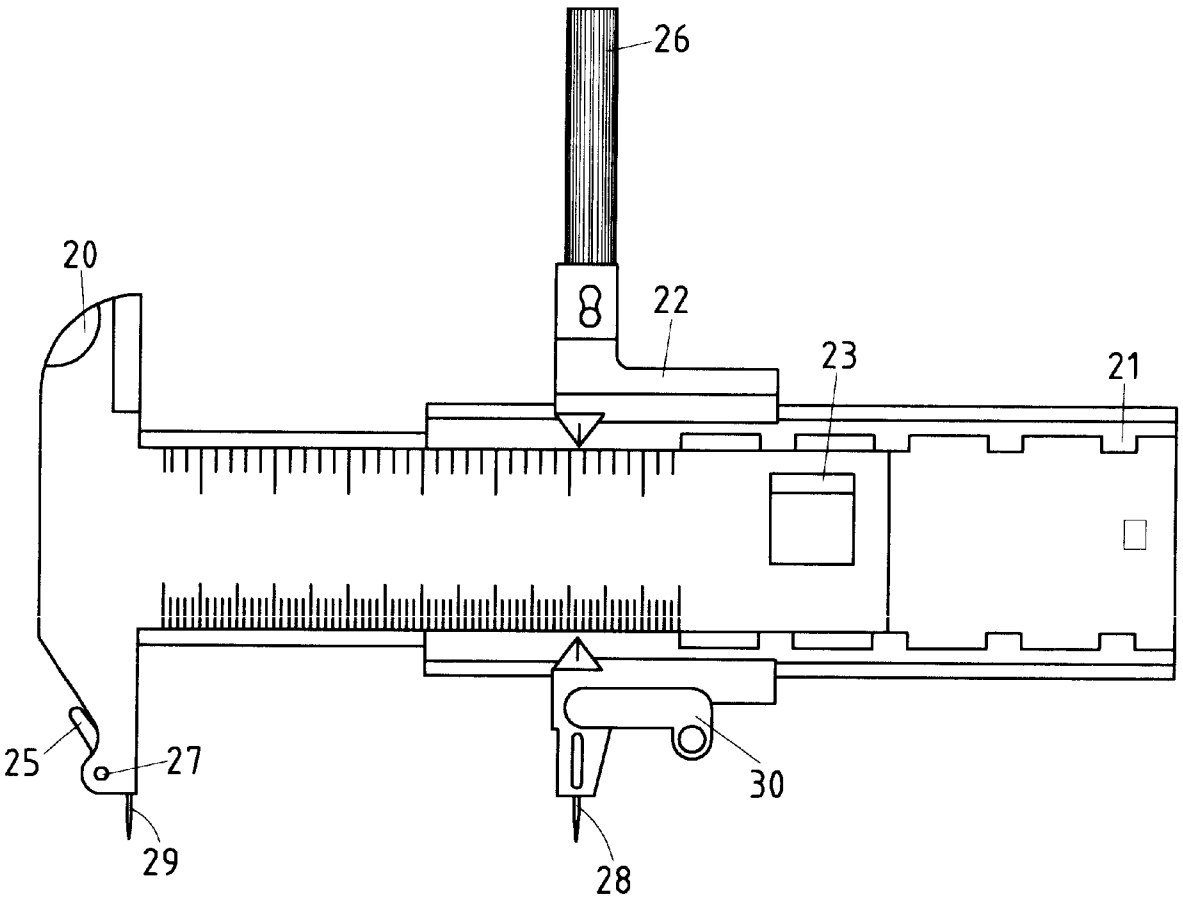
FIG. 4 shows a schematic view of the present invention in use.
Figure 5:
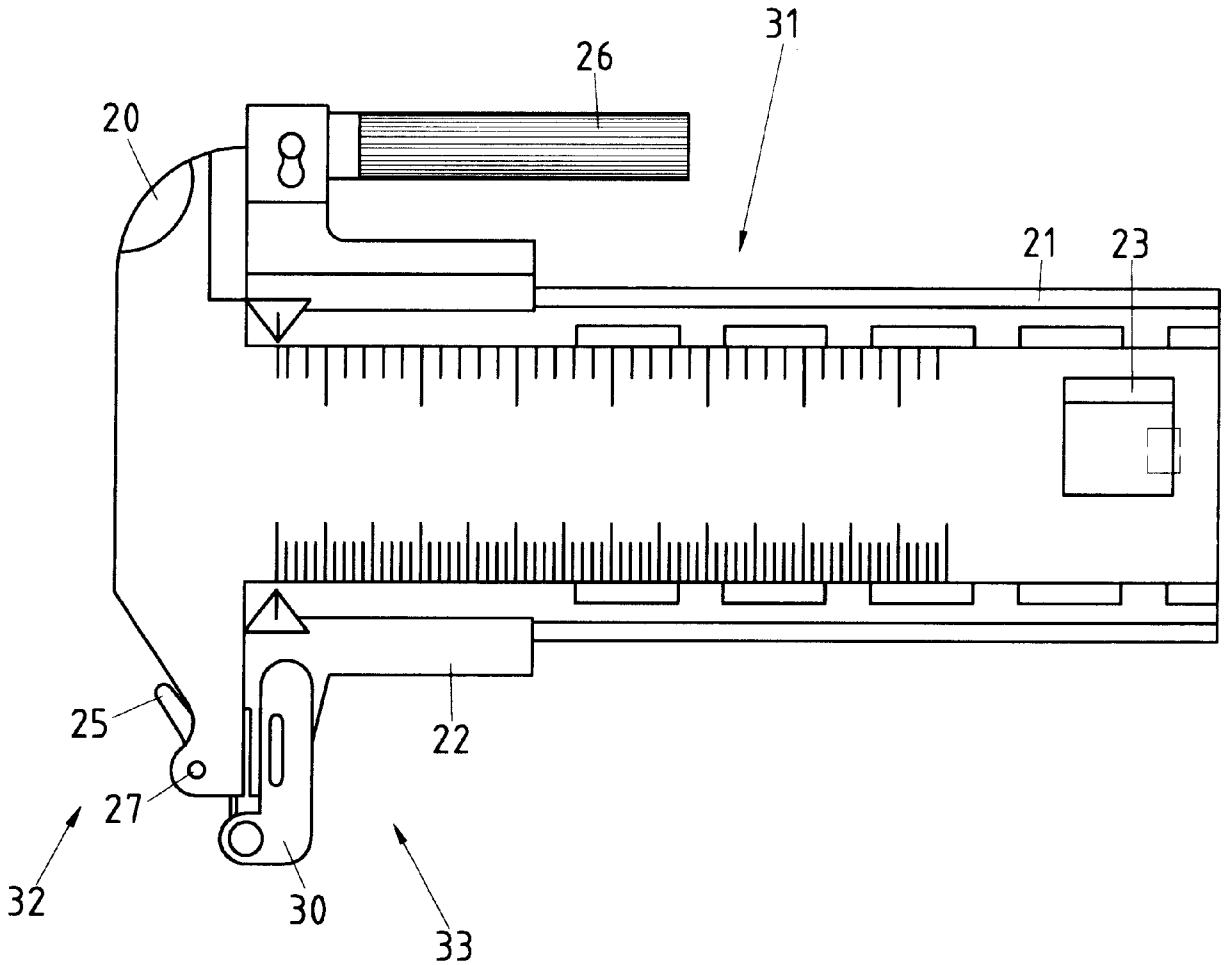
FIG. 5 shows a schematic view of the present invention in the folding state.
Figure 6:
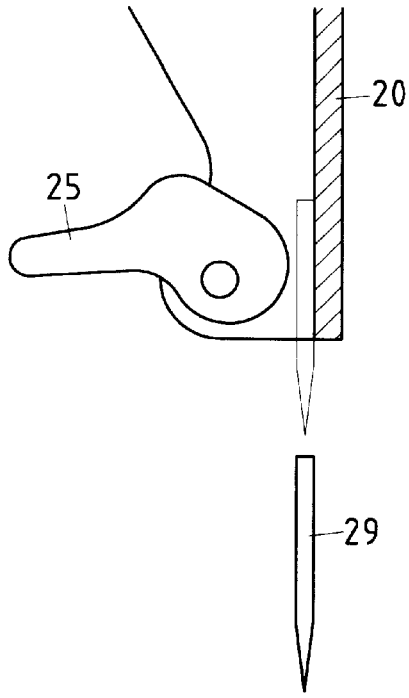
FIG. 6 shows a schematic view of the adjusting of the blade of the present invention.
Figure 7:
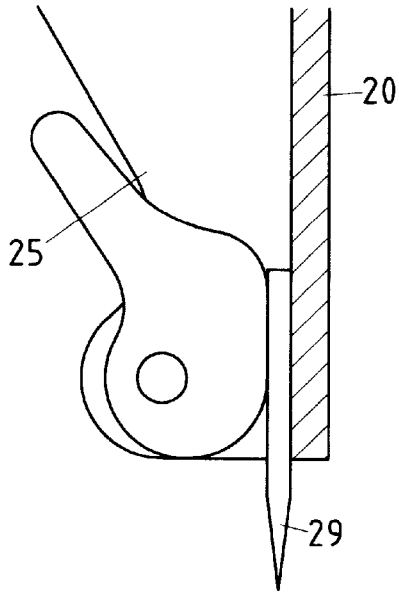
FIG. 7 shows a schematic view of the locating of the blade of the present invention.

As shown in FIGS. 2–7, a compass cutter 31 embodied in the present invention comprises a main body 20, an extension rod 21, and a slidable seat 22.

The main body 20 has an appropriate length, a stop end which is provided with a cutter member 32, and other end which is provided with a guide rail. The main body 20 is further provided with a fastening hole for fastening a locating block 23. The main body has a scale, and a receiving space for keeping the blade 29, the locating pin 28, etc. The receiving space is provided with a cover 24.

The extension rod 21 has a guide slot and a guide rail, two stop blocks 34 for confining the maximum sliding distances of the extension rod 21 and the slidable seat 22.

The slidable seat 22 is provided with a connection rod 26 pivoted therewith such that the connection rod 26 can be folded. The slidable seat 22 is provided in the bottom with a locating pin 28 and a safety member 33 having a projection 301. The slidable seat 22 is provided in two sides of the lower edge with a retaining slot 221 for locating the projection 301 of the safety member 33. The slidable seat 22 is provided with a locating block 23 in contact with the extension rod 21. The locating block 23 has an inclination.

The cutter member 32 of the present invention has a fixation block 25 for fixing the blade 29 at the stop end of the main body 20 in conjunction with an insertion pin 27. The fixation block 25 can be turned on the insertion pin 27 for regulating the point of the blade 29.

The safety member 33 of the present invention has a protective cover 30 for covering the locating pin 28 and the blade 29. The protective cover 30 is pivoted with the bottom of the slidable seat 22. The safety member 33 further has the projection 301 for locating the compass cutter 31 in storage.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

I claim:

1. A compass cutter comprising:

a main body having a length dimension, said main body having a stop end, said main body having a guide rail extending along said length dimension, said main body having a fastening hole formed adjacent an end opposite said stop end, said main body having a scale formed on a surface thereof, said main body having a receiving space adjacent said stop end;

a cutter member removably affixed to said stop end of said main body;

a locating block received within said fastening hole of said main body;

a cover affixed over said receiving space at said stop end of said main body;

an extension rod having a guide slot formed therein and slidably receiving said guide rail of said main body, said extension rod having a stop block means formed on a surface thereof, said stop block means for confining a maximum sliding distance of said extension rod relative to said main body;

a seat slidably received on a guide rail of said extension rod, said seat having a retaining slot formed along a first edge thereof;

a connection rod pivotally connected to a second edge of said seat, said connection rod pivotable between a first position extending transverse to said length dimension of said main body and a second position in parallel alignment with said length dimension;

a locating pin extending outwardly of said first edge transverse to said length dimension; and a safety member pivotally connected to said seat, said safety member having a projection extending therefrom, said safety member pivotable between a first position retained in said retaining slot and a second position covering said locating pin with said projection extending over an end of said locating pin.

2. The compass cutter of claim 1, said cutter member comprising:

a fixation means attached to said stop end of said main body for fixing a blade at said stop end, said fixation means comprising a fixation block pivotally mounted by an insertion pin to said stop end, said fixation block pivotable about said insertion pin so as to fix a length at which the blade extends outwardly of said main body.

* * * * *